US007871305B2

(12) United States Patent
Cohen

(10) Patent No.: US 7,871,305 B2
(45) Date of Patent: Jan. 18, 2011

(54) PUSH UP BRA

(75) Inventor: Kay Cohen, Sydney (AU)

(73) Assignee: Pleasure State Pty., Limited (AU)

( * ) Notice: Subject to any disclaimer, the term of this patent is extended or adjusted under 35 U.S.C. 154(b) by 162 days.

(21) Appl. No.: 12/330,742

(22) Filed: Dec. 9, 2008

(65) Prior Publication Data

US 2009/0233524 A1 Sep. 17, 2009

Related U.S. Application Data

(63) Continuation of application No. PCT/AU2007/000661, filed on May 16, 2007.

(30) Foreign Application Priority Data

Jun. 19, 2006 (AU) ..... 2006903150

(51) Int. Cl.
*A41C 3/00* (2006.01)

(52) U.S. Cl. ..... 450/57; 450/54

(58) Field of Classification Search ..... 450/36–38, 450/54–58; 2/267; 623/7, 8
See application file for complete search history.

(56) References Cited

U.S. PATENT DOCUMENTS

| | | | | | |
|---|---|---|---|---|---|
| 2,041,066 | A * | 5/1936 | Howard | 450/56 |
| 2,342,076 | A * | 2/1944 | Herbener | 450/56 |
| 3,384,091 | A * | 5/1968 | Block | 450/54 |
| 3,814,107 | A * | 6/1974 | Greenblatt et al. | 450/56 |
| 3,826,266 | A * | 7/1974 | Alpert | 450/11 |
| 3,834,397 | A * | 9/1974 | Birch | 450/56 |
| 5,098,330 | A | 3/1992 | Greenberg | |
| 5,334,082 | A * | 8/1994 | Barker | 450/31 |
| D373,236 | S | 9/1996 | Vass-Betts | |
| 5,873,767 | A | 2/1999 | Pickett | |
| 5,967,877 | A | 10/1999 | Howard | |
| 6,101,630 | A | 8/2000 | Lee | |
| 6,110,006 | A | 8/2000 | Chen | |
| 6,132,288 | A | 10/2000 | Aerts | |
| 6,165,047 | A | 12/2000 | Scott et al. | |
| 6,174,217 | B1 | 1/2001 | Judson | |
| 6,402,585 | B1 | 6/2002 | Gatto et al. | |
| 6,425,800 | B1 | 7/2002 | Huang | |
| 6,461,221 | B1 * | 10/2002 | Stilwell et al. | 450/57 |
| 6,544,100 | B1 | 4/2003 | Nadsady et al. | |
| 6,746,306 | B2 * | 6/2004 | Brothers | 450/41 |
| 6,953,380 | B2 * | 10/2005 | Brothers | 450/41 |
| 6,986,696 | B1 | 1/2006 | Jagaric et al. | |
| 6,997,775 | B2 | 2/2006 | Jagaric et al. | |
| 7,052,360 | B2 | 5/2006 | Lau | |
| 7,074,108 | B2 | 7/2006 | Knox | |
| 7,311,583 | B2 | 12/2007 | Jagaric et al. | |

* cited by examiner

*Primary Examiner*—Gloria Hale
(74) *Attorney, Agent, or Firm*—Roy Kiesel Ford Doody & Thurmon, APLC

(57) ABSTRACT

Disclosed in this specification is a range of push up bras. The range comprises different bra cup sizes, and offers a different amount of padding for different cup sizes in the same range. The different padding provided facilitates a better tailoring of the bra to the body type of the wearer. The padding occupies a decreasing area of the cup as the cup size increases. The centre of the padding is also gradually lowered with increasing cup size.

13 Claims, 8 Drawing Sheets

PUSH UP BRA

CROSS-REFERENCE TO RELATED APPLICATIONS

This application claims the benefit of PCT Application No. PCT/AU2007/000661, filed May 16, 2007, and Australian Application No. 2006903150, filed Jun. 9, 2006, which are hereby incorporated by reference in their entireties.

FIELD OF THE INVENTION

The invention relates to bras and more particularly to padded push up bras.

BACKGROUND OF THE INVENTION

Push up bras are well known. The purpose of a push up bra is to enhance the cleavage of the wearer. It is common for a particular style of push up bra to be provided in a variety of sizes. In this document a collection of bras of different cup sizes is referred to as a range. In conventional bra manufacturing practice, the padding provided within a push up bra may take the form of cut and sewn panels, inserted padding or fully molded polyurethane foam cups that have the push up pad pre-formed into the cup. However, the convention practice is to utilize essentially the same padding shape across an entire range.

OBJECTS AND SUMMARY OF THE INVENTION

It is an object of the invention to provide enhanced push up bra constructions, particularly by offering different pad shapes within a given range so as to provide a graduation of cleavage enhancement across the range. The outcome is a degree of enhancement appropriate to a particular wearer within that range.

Accordingly, there is provided a range of push up bras of different cup sizes, each bra comprising two bra cups, the cups being separated by a center-front area. Each cup further comprises a top cup line that extends from the center front area to a vertical maximum point in proximity with a shoulder strap seam, an underarm line that extends from the shoulder strap seam to a back strap, and a padded area. Each padded area comprises a lower periphery and an upper periphery, wherein a size of the padded area gradually decreases with a size of the bra cup.

BRIEF DESCRIPTION OF THE FIGURES

In order that the invention be better understood, reference is now made to the following drawing figures in which.

BEST MODE AND OTHER EMBODIMENTS OF THE INVENTION

Figure 1:
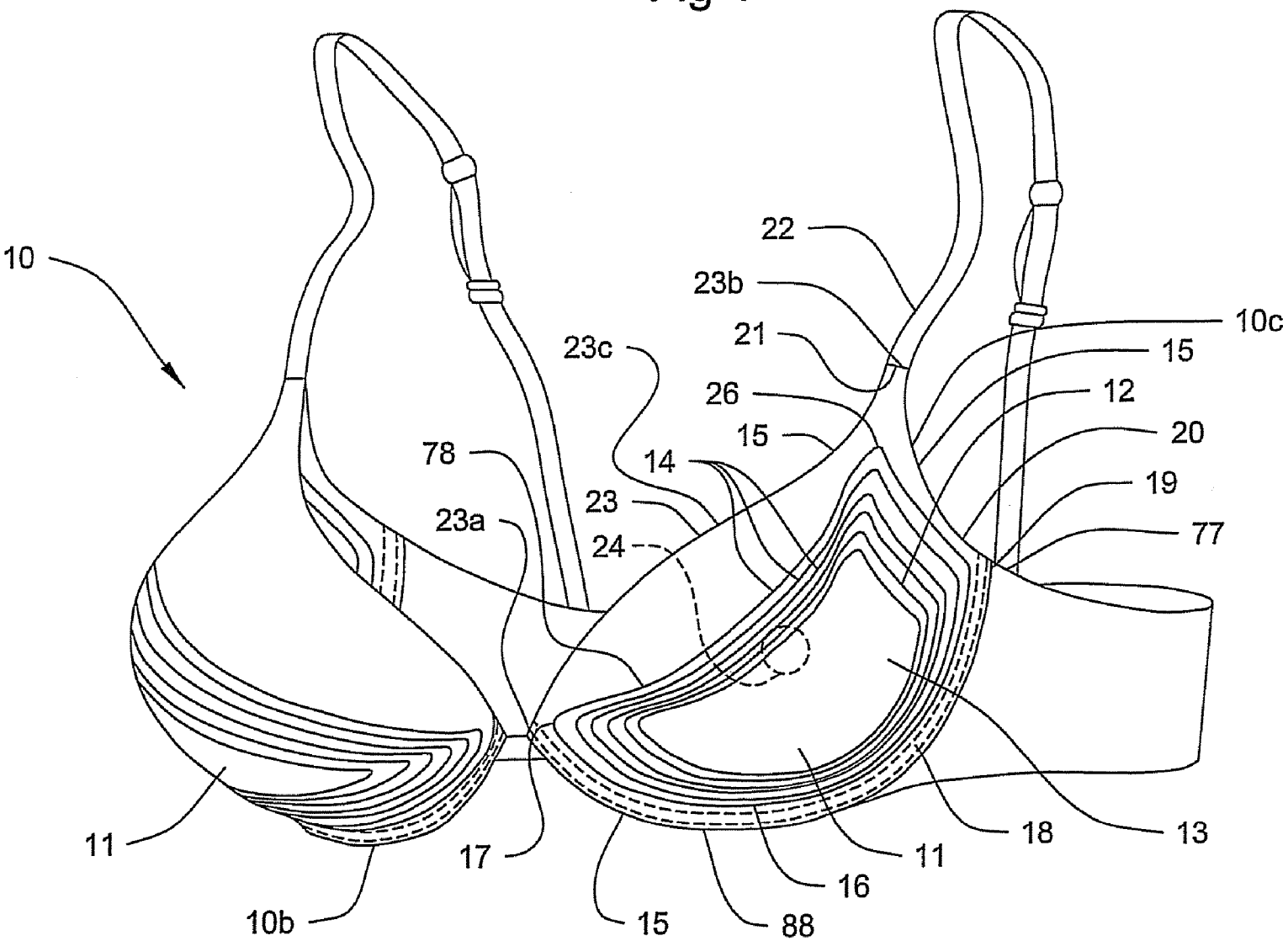
FIG. 1 is a perspective of an A cup push up bra incorporating the teachings of the present invention.

Bras including push up bras are available in a variety of cup sizes including A cup, B cup and C cup. It will be appreciated that an A cup wearer may have practically any body size (as with the other cup sizes) but the A cup wearer will typically have very little or no natural bust. Accordingly, the invention provides an A cup push up bra that offers full bust and cleavage enhancement as depicted in FIG. 1. The A cup bra 10 depicted in FIG. 1 incorporates substantial padding 11 in the lower cup 10*b* as well as a booster pad area 12 in the sides 10*c* of the cups 10. The example depicted in FIG. 1 is approximately 85% padded. The required padding 11 is preferably provided by way of a fully molded polyurethane cup 10 that incorporates an integral padding area 11. As illustrated, the maximum thickness of the padding area 11 is in the central part 13 of the padding near the apex 24. Note that the padding 11 covers the apex area 24 of the cup 10. The contour lines 14 illustrate the fact that the thickness of the padded area 11 tapers toward the peripheral edges 15 of the cup 10.

The lower periphery 16 of the padded area 11 is defined by a curve 16 that extends essentially from the area closely adjacent to the centerfront 17, following the curve of the underwire 88 or the cup's 10 lower edge 18 to the lateral extent 19 of the pad 11 where the aforesaid curvature joins the underarm line 20 at a juncture 77. The lateral periphery 19 of the padded area 11 continues from this juncture 77 essentially parallel with the underarm line 20 to a vertical maximum point 26 in proximity with the cup's shoulder strap seam 21. The upper peripheral extent 78 of the pad 11 continues toward the centerfront area 17 but diverges from the top cup line 23. As illustrated the maximum divergence occurs toward the middle 23*c* of the top cup line 23 and approaches the top cup line 23 at each end, 23*a* and 23*b*.

Figure 2:
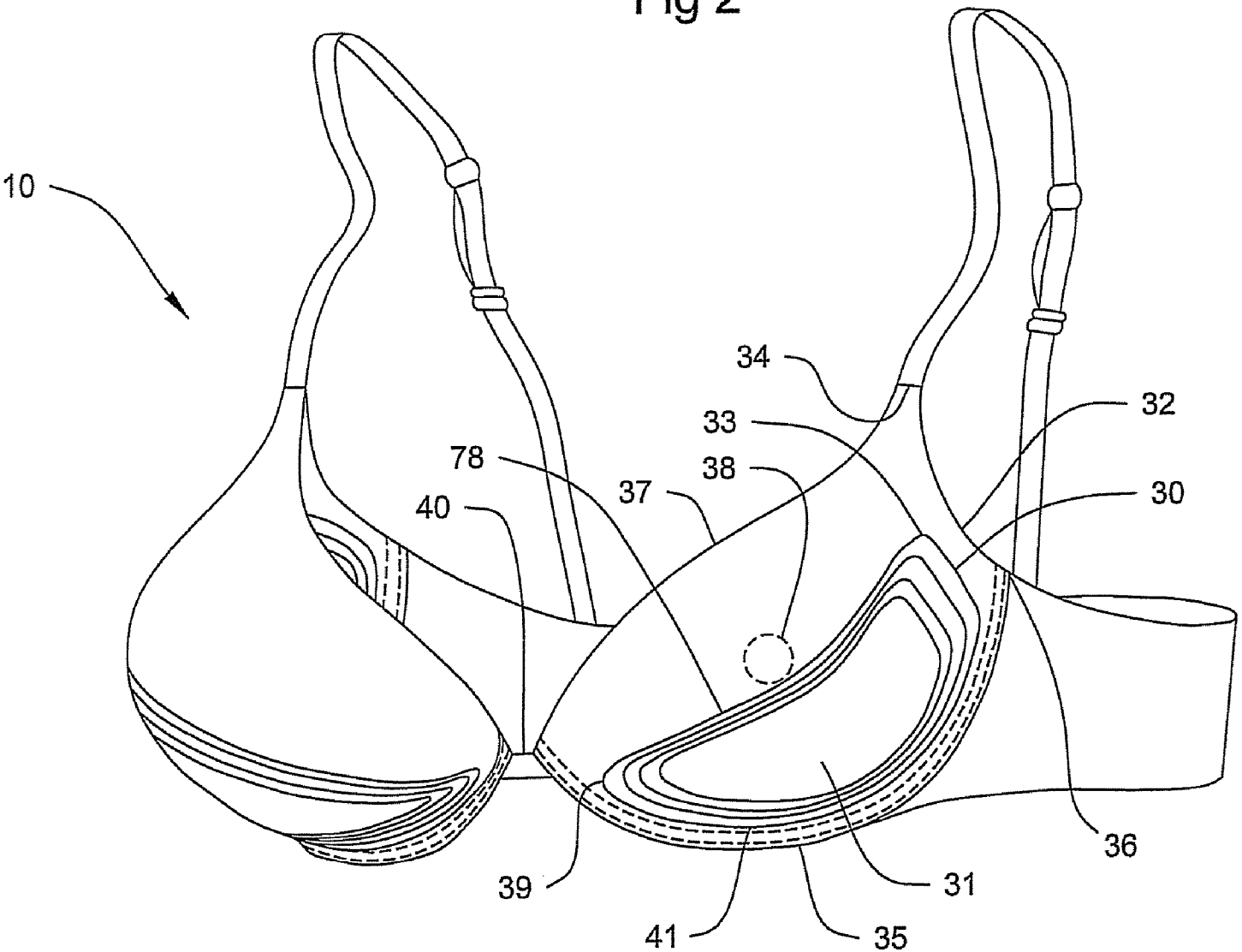
FIG. 2 is a perspective of a B cup push up bra incorporating the teachings of the present invention.

FIG. 2 illustrates a B cup 10 which is intended to be manufactured in the lateral same range as the A cup 10 depicted in FIG. 1. As shown in this example, the lateral periphery 30 of the pad 31 is retracted somewhat from the underarm line 32. Similarly, the vertical maximum of the padding 31 is retracted to a point 33 which is approximately half way between the shoulder strap seam 34 and the juncture 36 between the underwire 35 and the underarm line 32. The retraction of the upper periphery 88 from the top cup line 37 is greater than in the A cup 10 depicted in FIG. 1 and in preferred embodiments fails to cover the apex area 38 of the cup 10. In addition the medial extent 39 of the periphery is retracted from the area of the centrefront 40. The lower periphery 41 closely follows the contours of the underwire 35 and is adjacent to it. The B cup 10 is considered approximately 50% padded.

Figure 3:
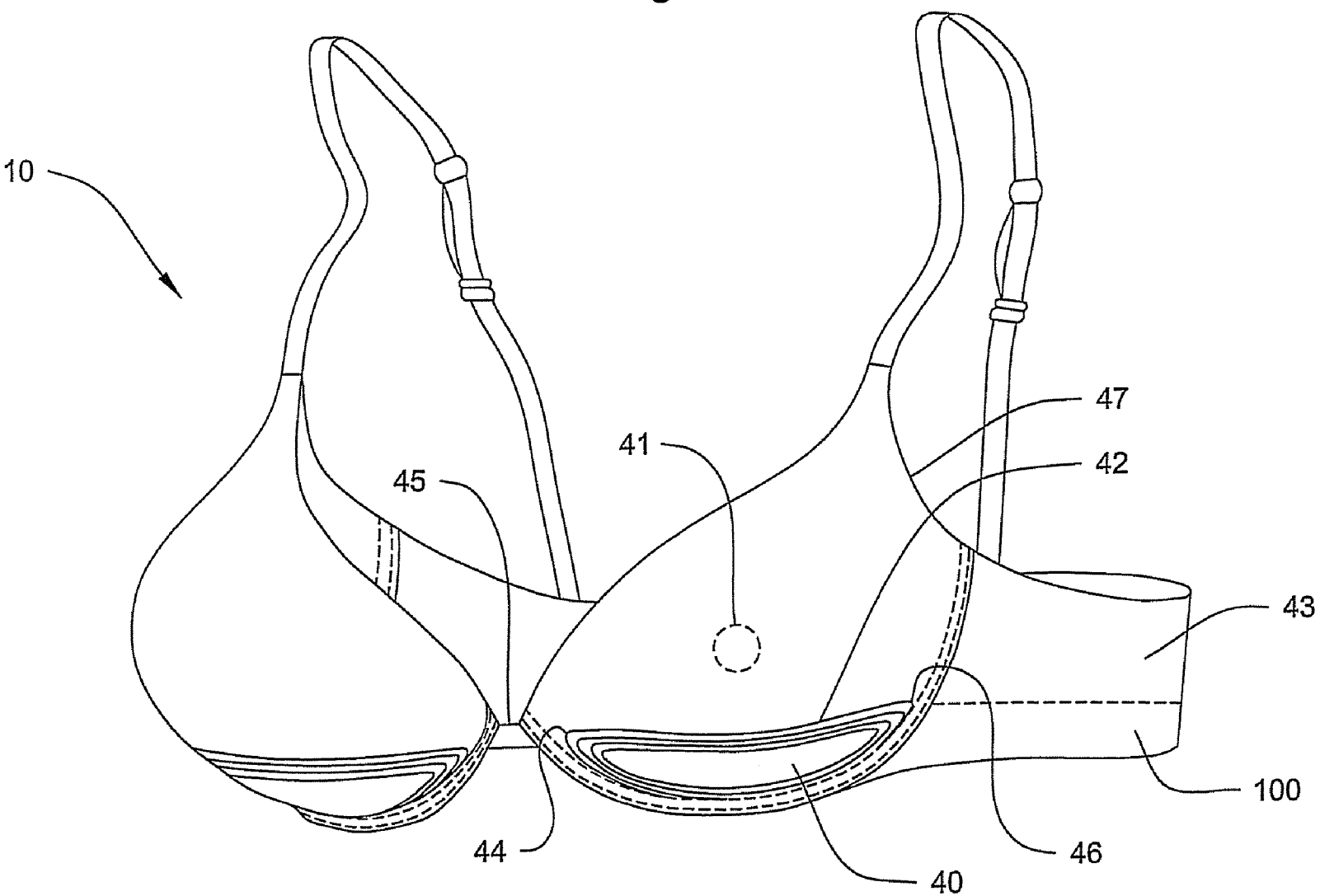
FIG. 3 is a perspective of a C cup push up bra incorporating the teachings of the present invention.

A C cup 10 manufactured in the same range as the A and B cup 10 bras depicted in FIGS. 1 and 2 is shown in FIG. 3. In this embodiment, the upper periphery 42 of the integral molded pad 40 extends well below the apex 41 and has an upper peripheral margin 42 that is generally horizontal (parallel) with the main axis 100 of the back wing 43. The medial extent 44 is more retracted from the centerfront 45 and the vertical maximum 46 is more retracted from the underarm line 47 than the B cup 10 example provided in FIG. 2. Thus, the C cup pad 40 provides a smaller pillow than either the A or B cup 10 examples and the pillow rests directly beneath the bust area of a typical wearer, adding approximately 25% additional padding.

Figure 4:
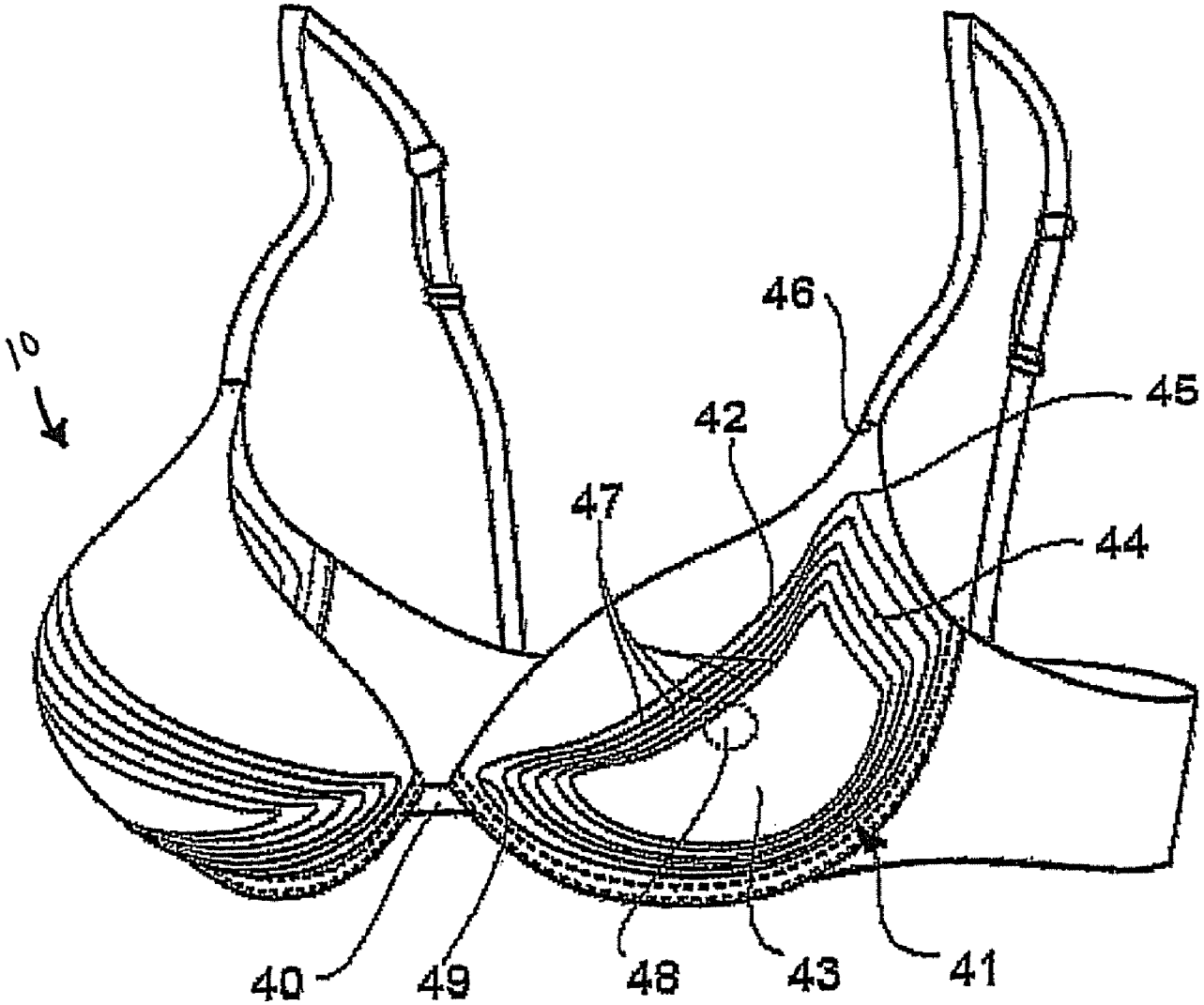
FIG. 4 is a perspective of an AA cup push up bra from a size range that is wider, incorporating the teachings of the present invention.

As shown in FIGS. 4 to 8, the present teaching can also be adapted to cover more sizes, including, but not limited to, AA and D/DD cups 10. There is a more graduated change between the bra cups 10 in ranges that cover sizes. As shown in FIG. 4, in the AA cup bra 10, the padding area 41 covers a substantial area of the bra 10. The AA cup bra 10 is similar to the A cup bra 10 depicted in FIG. 1 but with the following differences. The peripheral edges 42, of the main padded area 43 as well as the booster pad 44, converge to a vertical maximum point 45. This vertical maximum point 45 reaches near the shoulder strap seam 46. As shown by the contour lines 47, the thickness of the padding 41 begins to taper (i.e. reduce) above the apex 48. The medial extent 49 of the padding 41 reaches close to the center-front 40 of the bra 10. The AA cup 10 is considered approximately 100% padded.

Figure 5:
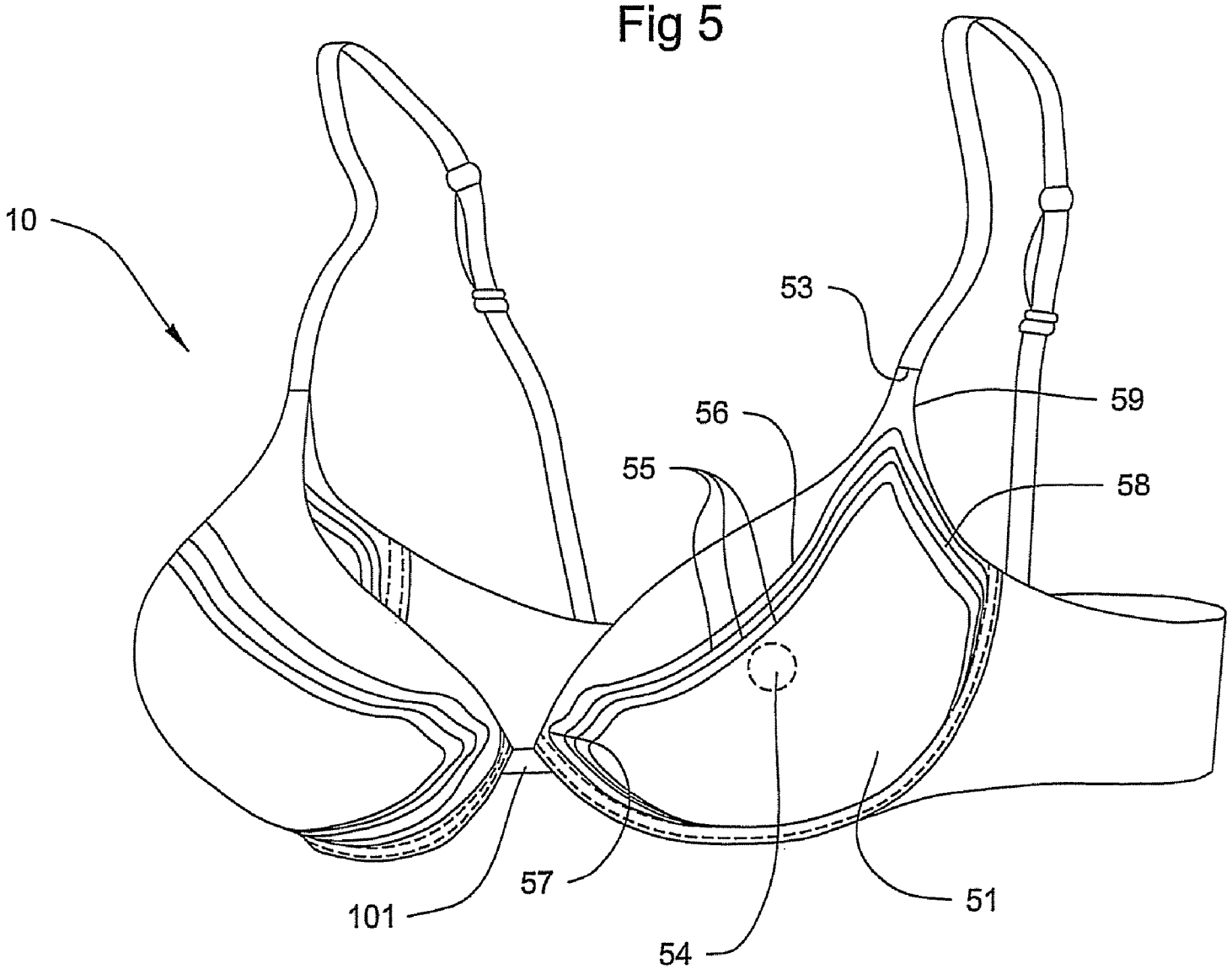
FIG. 5 is a perspective of an A cup push up bra from a size range that is wider, incorporating the teachings of the present invention.

Referring to FIG. 5, the A cup bra 10 has a smaller padding 51 coverage compared to the AA cup bra 10. Like the A cup bra 10, the padding 51 also includes a booster pad area 58 near the underarm line 59. Compared to that in the AA cup 10 (see FIG. 4), the padding 51 in the A cup 10 has a vertical maximum point 52 that lies slightly farther away from the shoulder strap seam 53. The padding 51 thickness starts to taper in the apex area 54. The contour lines 55 show that the tapering of the padding 51 thickness begins farther from the peripheral edges 56 in the A cup 10 than in the AA cup 10. The medial extent 57 is more retracted from the center-front 101 in the A cup 10 than in the AA cup 10. The A cup 10 is considered approximately 85% padded.

Figure 6:
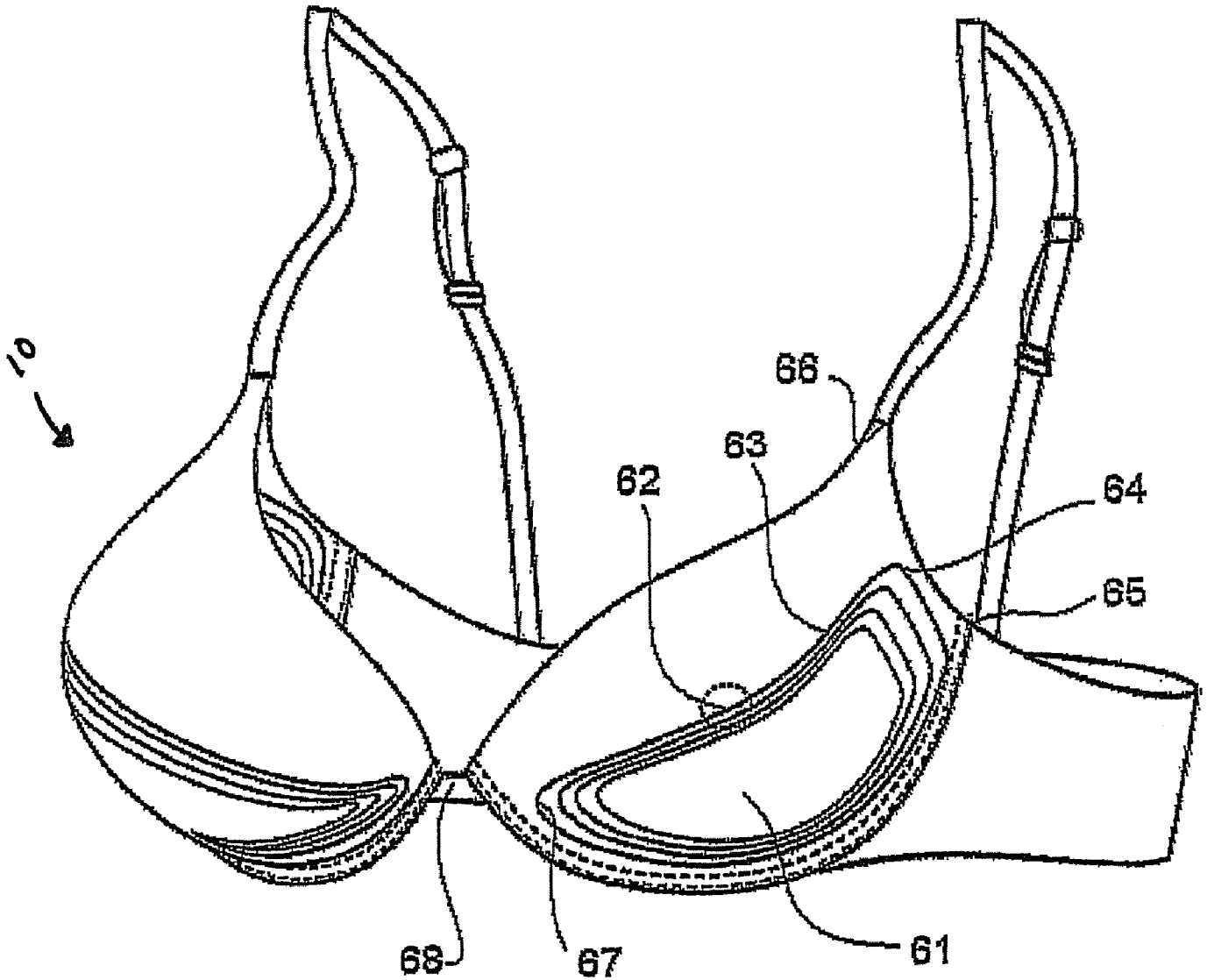
FIG. 6 is a perspective of another B cup push up bra from a size range that is wider, incorporating the teachings of the present invention.

Referring to FIG. 6, in the B cup bra 10, the maximum thickness of the padding 61 lies below the apex 62. Unlike the A and AA cup bras 10, the padding 61 incorporates little or no booster pad area. The B cup bra 10 in this range is substantially the same as the B cup bra 10 depicted in FIG. 2, except that the periphery 63 of the padding 61 partially covers the apex 62. The vertical maximum point 64 generally lies approximately half way between the underarm-underwire juncture 65 and the shoulder strap seam 66. The medial extent 67 of the padding 61 is more retracted from the center-front 68 compared to the A and AA cups 10. The B cup 10 is considered approximately 50% padded.

Figure 7:
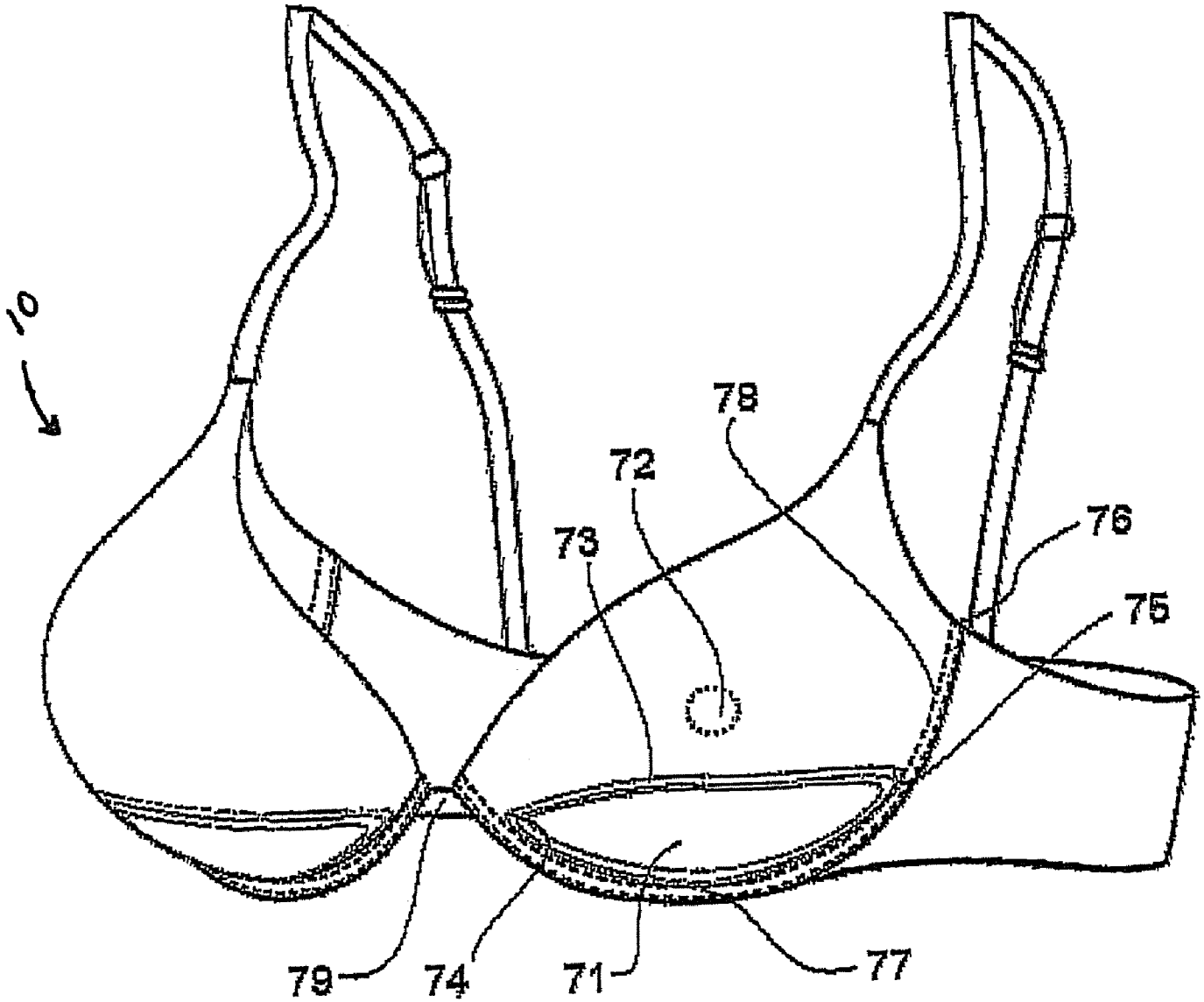
FIG. 7 is a perspective of another C cup push up bra from a size range that is wider, incorporating the teachings of the present invention.

Referring to FIG. 7, in the C cup bra 10, the entire padding area 71 lies below the apex 72. This C cup bra 10 is the largely the same as the C cup bra 10 depicted in FIG. 3, but has a different upper periphery margin 73. The upper periphery margin 73 is slightly curved, and extends between a medial extent 74 and a lateral extent 75. The medial extent 74 is more retracted from the center-front 79. The lateral extent 75 lies below the underwire-underarm juncture 76, and is generally half way between the juncture 76 and a lowest extent 77 of the underwire 78. The margin 73 curves upwardly, but only very slightly so, from the medial extent 74 to a location approximately below the apex 72. The margin 73 is substantially horizontal from the area below the apex 72 to the lateral extent 75. The padding 71 in the C cup 10 pushes up the bust from below, but includes no booster pad portion. The C cup 10 is considered approximately 25% padded.

Figure 8:
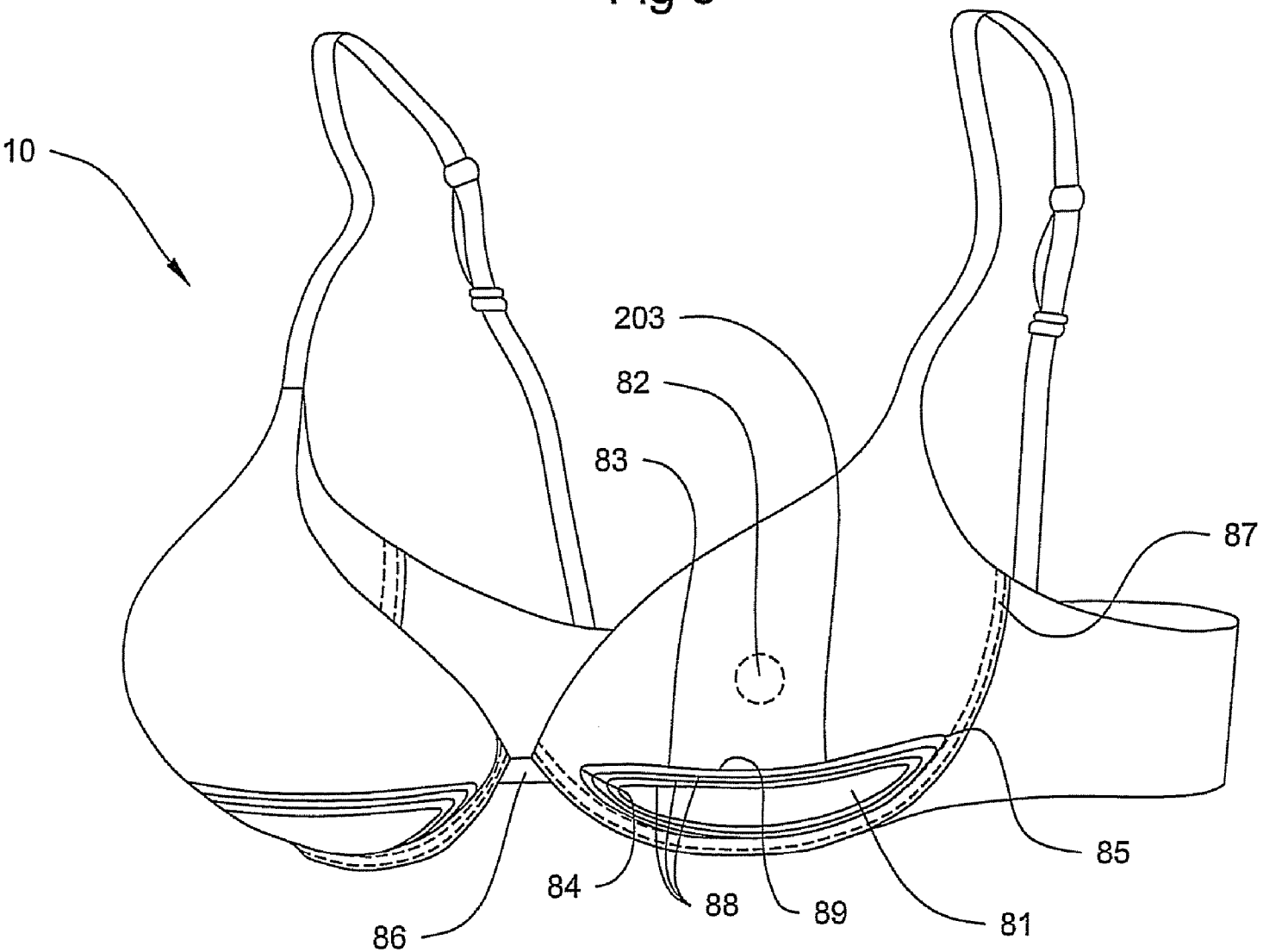
FIG. 8 is a perspective of a D cup push up bra from a size range that is wider, incorporating the teachings of the present invention.

Referring to FIG. 8, in the D/DD cup bra 10, the entire padding area 81 also lies below the apex 82. The padding 81 covers an even smaller percentage of the bra 10 in the D/DD cup 10 than in the C cup 10. The upper periphery margin 83, which is slightly curved but substantially horizontal, extends between a medial extent 84 and a lateral extent 85. Compared to other bra sizes, the D/DD cup 10 medial extent 84 is the most retracted from the center-front 86 and the lateral extent 85 is most retracted from the underwire-underarm juncture 87. As shown by the contour lines 88, the padding 81 thickness tapers off toward the periphery 83. The contour lines 88 also show that the upper periphery margin 83 has a slightly downward curve 89 that is located generally in a central part 203 of the margin 83. The padding 81 thus cradles the bust from below. The D/DD cup 10 offers the least amount of coverage.

It should be noted that the percentage of padding coverage is only approximate and is not fixed. The coverage can vary, for example, between different band sizes.

In preferred embodiments, bras made in accordance with the teachings of the present invention feature predominant use of woven fabrics. Conventional bra design features predominantly knitted fabrics. The molded polyurethane cups of the present invention may be laminated with micro fiber, a light weight material with a "peach skin" touch. However, any fabrication can be applied to bras of the present invention. Preferred embodiments of the invention utilize a micro fiber back strap, fused front shoulder straps and a micro fiber concealed hook and eye tape.

While the present invention has been disclosed with reference to particular details of construction, these should be understood as having been provided by way of example and not as limitations to the scope or spirit of the invention. It will be appreciated that the invention extends to one, two or more bras in a range and that bras are sold in ranges and as ranges by designers to manufacturers, distributors, wholesalers and retailers.

The invention claimed is:

1. A range of differently sized push-up bras, each bra comprising a pair of padded cups having padding therein connected by a central front and a back strap, each cup having an apex centrally positioned in said cup wherein the range comprises:

a. at least an A-cup size bra and a B-cup size bra;

b. wherein said padding is positioned in each cup from a point below the apex and extending upward a distance that is inversely proportional to the cup size of the bras in said range, such that said padding occupies a decreasing area of each cup as the cup size increases;

c. wherein said padding covers the apex in the A-cup size bra and wherein said padding does not cover the apex in the B-cup size bra.

2. The range according to claim 1, wherein the padding in the A-cup size bra comprises about 85% of the area of each cup.

3. The range according to claim 1, wherein the padding in the B-cup size bra comprises about 50% of the area of each cup.

4. The range according to claim 1 further comprising a C-cup size bra, wherein the padding comprises about 25% of the area of each cup.

5. The range according to claim 1 further comprising a C-cup size bra, wherein the padding does not cover the apex in the C-cup size bra.

6. The range according to claim 5 further comprising a D-cup size bra, wherein the padding does not cover the apex in the D-cup size bra.

7. A range of differently sized push-up bras, each bra comprising a pair of padded cups having padding therein connected by a central front and a back strap, each cup having an apex centrally positioned in said cup, wherein each cup comprises a bottom cup line, and a top cup line that extends from the central front to a vertical maximum point of the cup, wherein the vertical maximum point of the cup meets with a shoulder strap seam, wherein each cup further comprises an underarm line that extends from the shoulder strap seam to the back strap, wherein the range comprises:

a. at least an A-cup size bra and a B-cup size bra;

b. wherein said padding is positioned in each cup from a point below the apex and extending upward a distance that is inversely proportional to the cup size of the bras in said range, such that said padding occupies a decreasing area of each cup as the cup size increases;

c. wherein the padding in the A-cup size bra comprises a lateral periphery that is substantially parallel with the underarm line of the A-cup size bra;

d. wherein the padding in the B-cup size bra comprises a lateral periphery that is substantially parallel with the underarm line of the B-cup size bra e. wherein the lateral periphery of the padding in the B-cup size bra is shorter than the lateral periphery of the padding in the A-cup size bra.

8. The range according to claim 7 wherein the lateral periphery of the padding in the B-cup size bra is at a greater distance from the underarm line of the B-cup size bra than the lateral periphery of the padding in the A-cup size bra is from the underarm line of the A-cup size bra.

9. The range according to claim 7, further comprising a C-cup size bra, wherein the padding in the C-cup size bra does not comprise a lateral periphery that is substantially parallel with the underarm line of the C-cup size bra.

10. The range according to claim 9, further comprising a D-cup size bra, wherein the padding in the D-cup size bra does not comprise a lateral periphery that is substantially parallel with the underarm line of the D-cup size bra.

11. A range of differently sized push-up bras, each bra comprising a pair of padded cups having padding therein connected by a central front and a back strap, each cup having an apex centrally positioned in said cup wherein the range comprises:

a. at least an A-cup size bra and a B-cup size bra;

b. wherein said padding is positioned in each cup from a point below the apex and extending upward a distance that is inversely proportional to the cup size of the bras in said range, such that said padding occupies a decreasing area of each cup as the cup size increases;

c. wherein said padding extends horizontally across each cup to a point spaced from the central front and wherein the distance from said central front to said point is directly proportional to the cup size of the bras in said range, such that said distance from said central front increases as the cup size increases.

12. The range according to claim 11, further comprising a C-cup size bra and a D-cup size bra.

13. A range of differently sized push-up bras, each bra comprising a pair of padded cups having padding therein connected by a central front and a back strap, each cup having an apex centrally positioned in said cup, wherein each cup comprises a bottom cup line, and a top cup line that extends from the central front to a vertical maximum point of the cup, wherein the vertical maximum point of the cup meets with a shoulder strap seam, wherein each cup further comprises an underarm line that extends from the shoulder strap seam to the back strap, wherein the range comprises:

a. at least an A-cup size bra and a B-cup size bra;

b. wherein said padding is positioned in each cup from a point below the apex and extending upward a distance that is inversely proportional to the cup size of the bras in said range, such that said padding occupies a decreasing area of each cup as the cup size increases;

c. wherein said padding in each cup extends to a vertical maximum point;

d. wherein the vertical maximum point of the padding in the A-cup size bra is in proximity to the vertical maximum point of the cup; and wherein the vertical maximum point of the padding in the B-cup size bra is situated at a point about halfway between the shoulder strap seam and the bottom cup line.

* * * * *